US005989167A

United States Patent [19]

Manley et al.

[11] Patent Number: 5,989,167

[45] Date of Patent: Nov. 23, 1999

[54] ABDOMINAL EXERCISE NECK SUPPORT

[76] Inventors: Michael Patrick Manley, 1090 Oakwood Rd., Ortonville, Mich. 48462; James Joseph Manley, 17671 Barry, Clinton Township, Mich. 48038

[21] Appl. No.: 09/046,775

[22] Filed: Mar. 13, 1998

[51] Int. Cl.[6] ..... A63B 23/02

[52] U.S. Cl. ..... 482/140; 482/10; 482/92; 482/95; 482/131; 482/132; 482/139; 5/636; 5/637; 5/643; 606/240; 601/39

[58] Field of Search ..... 482/10, 92, 95, 482/122, 123, 131, 132, 139, 140, 148, 508; D21/687–691; 601/39; 606/240; 5/636, 637, 643; 128/845, 869, 870; D24/190, 191; D29/102

[56] References Cited

U.S. PATENT DOCUMENTS

| | | | |
|---|---|---|---|
| D. 385,601 | 10/1997 | Uen | D21/691 |
| 5,122,107 | 6/1992 | Gardner | 482/140 |
| 5,295,949 | 3/1994 | Hathaway . | |
| 5,637,067 | 6/1997 | Ausmus | 482/140 |
| 5,681,248 | 10/1997 | Vani . | |
| 5,759,138 | 6/1998 | Boland | 482/122 |
| 5,772,562 | 6/1998 | Stevens | 482/140 |
| 5,776,042 | 7/1998 | Szabo | 482/140 |
| 5,792,035 | 8/1998 | Ward et al. | 482/140 |
| 5,807,220 | 9/1998 | Allis et al. | 482/140 |
| 5,816,985 | 10/1998 | Ho | 482/140 |

*Primary Examiner*—Richard J. Apley
*Assistant Examiner*—Lori L. Baker Smith
*Attorney, Agent, or Firm*—Harness, Dickey & Pierce, PLC

[57] ABSTRACT

An exercise device is provided including a head, neck and thoracic supporting member spaced apart from a force receiving or hand grip member. A connecting member extends at a pre-selected angle between the head, neck and thoracic supporting member and the hand grip member. The connecting member includes at least one pivot for cooperating with a portion of a user to provide leveraging of the head, neck and thoracic supporting member via the hand grip member.

16 Claims, 3 Drawing Sheets

ABDOMINAL EXERCISE NECK SUPPORT

BACKGROUND OF THE INVENTION

1. Technical Field

The present invention generally relates to exercise devices and, more particularly, to a support device for supporting the neck region of an individual performing abdominal crunches.

2. Discussion

Comprehensive conditioning of the human body has traditionally required numerous exercise machines. Such machines include multi-station mini-gyms as well as uniquely configured units dedicated to isolated muscle groups. These machines are typically large, heavy, and expensive, and therefore are usually located in health clubs, gymnasiums or the like. As such, users of such machines must make the added effort of travelling to a remote location and even then perhaps waiting for the availability of certain machines.

Despite the number and sophistication of modern day exercise machines, the human abdomen remains one of the most difficult body parts to keep conditioned. Weak stomach muscles can cause a myriad of maladies, particularly including back problems. For decades, the traditional "sit-up" was deemed the best way to condition stomach muscles. However, experience has shown that sit-ups can prove counter-productive, not only by contributing to neck and back problems, but also by enlarging particular stomach muscles rather than flattening them.

More recently the "crunch" has become more accepted as an effective and less traumatic therapy for the human abdomen. However, even crunch type exercises, if not done correctly, or done to extremes, can lead to various injuries along the spinal column and more particularly in the segmented vertebrae located adjacent the cervical-thoracic junction of the spinal column. The cervical area is located in the neck of the body and includes seven cervical vertebrae which are smaller than those in any other region of the spine. The thoracic region is located below the cervical vertebrae and is connected thereto at its upper end. The thoracic region includes twelve dorsal vertebrae and is connected at its lower end to the lumbar vertebrae. As can be appreciated, the cervical-thoracic region is a very complicated and delicate structure that may be placed under considerable stress during many types of exercises, including strenuous crunch-type activities.

Until now, no simple solution has been suggested or devised to maintain the cervical-thoracic region in an optimum posture during exercise for preventing accidental injury. Accordingly, it is an object of the present invention to relieve the type of stress along the cervical-thoracic region that may occur while exercising.

SUMMARY OF THE INVENTION

The above and other objects are provided by an exercise device including a head, neck and thoracic supporting member spaced apart from a force receiving or hand grip member. A rigid connecting member extends at a pre-selected angle between the head, neck and thoracic supporting member and the hand grip member. The connecting member includes at least one pivot for cooperating with a fulcrum on the chest of a user to provide leveraging of the head, neck and thoracic supporting member via the hand grip member.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards an exercise device for assisting a user during performance of crunch-type exercises. The exercise device of the present invention supports the cervical-thoracic region, commonly referred to as the neck and upper back area, during strenuous exercises. More particularly, the present invention supports the cervical-thoracic region through leveraging during crunch exercises during which a person lying flat on her back rises to a near sitting position without using her hands.

Figure 1:
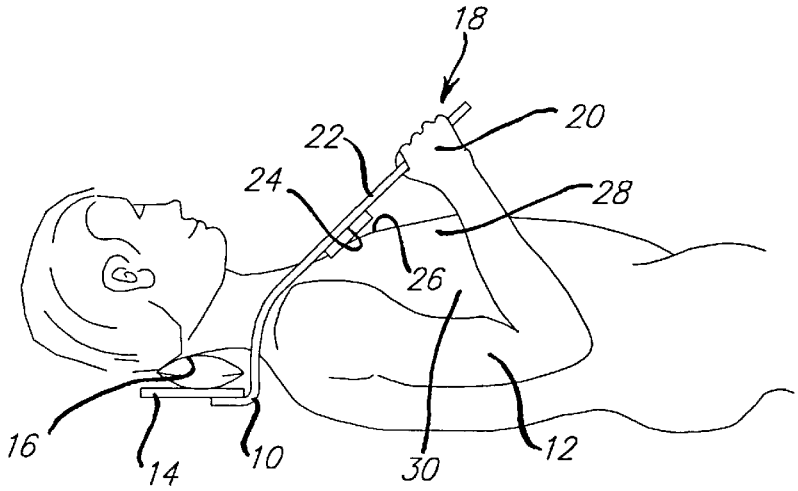
FIG. 1 is a diagrammatic view showing how the exercise device of the present invention is positioned under the neck area of the user while in a reclining position.
Figure 2:
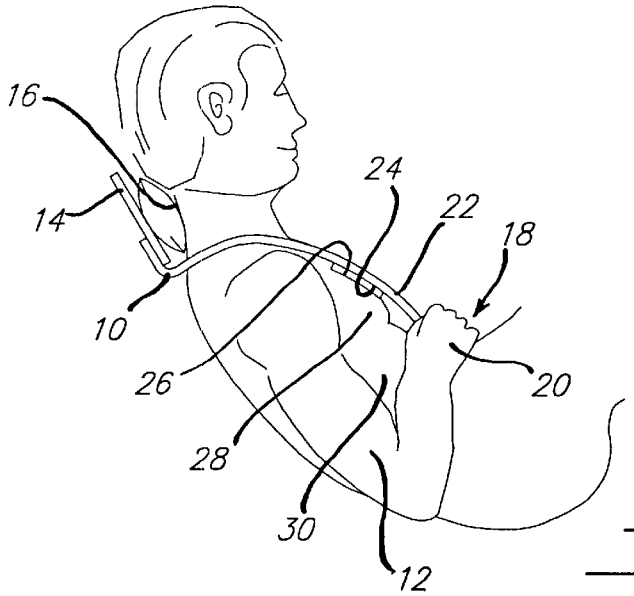
FIG. 2 is a diagrammatic view showing how the exercise device supports the neck area of the user through leveraging while in an upright crunched position.

Referring now to the drawing figures, FIGS. 1 and 2 illustrate the exercise device 10 of the present invention being utilized by a user 12 while performing crunch-type exercises. While the exercise device 10 is illustrated in conjunction with crunch type exercises, one skilled in the art will appreciate that the device 10 may also be utilized during other types of exercises wherein support of the cervical-thoracic region is desired. The exercise device 10 includes a first or head, neck and thoracic supporting member 14 disposed beneath the neck or cervical-thoracic region 16 of the user 12. A force receiving or hand grip portion 18 is spaced apart from the head, neck and thoracic supporting member 14 and is preferably adapted to be gripped by the hands 20 of the user 12. Although the force receiving member 18 is preferably a hand grip member, it is contemplated that other portions of the user's arms such as the forearms, elbows or triceps may be used to apply force thereto. Further, although the first supporting member 14 is illustrated disposed beneath the neck of the user 12, it is contemplated that the first support member 14 may be disposed proximate any or all of the neck region including the upper back, neck and/or head.

A connecting member 22 extends at a preselected angle between the head, neck and thoracic supporting member 14 and the hand grip member 18 for providing leverage to the head, neck and thoracic supporting member 14. The connecting member 22 includes a padded pivot region 24 for cooperating with a fulcrum 26 along the chest 28 of the user 12 to provide leveraging of the head, neck and thoracic supporting member 14 via the hand grip member 18 as slight pressure is applied thereto by the user 12. It should be noted that the fulcrom 26 is not necessarily a discrete component, but rather is preferably a portion of the chest 28 of the user 12 along which the connecting member 22 rests.

In operation, the user 12 applies slight downward pressure on the hand grip portion 18 thereby forcing the head, neck and thoracic supporting member 14 against the cervical-thoracic region 16 by the pivoting of the connecting member 22 about the fulcrum 26 on the chest 28 of the user 12. While the abdominal muscles are being used to lift the torso 30 during an ab crunch, the exercise device 10 maintains the cervical-thoracic region 16 in the proper posture. As such, stress of the cervical-thoracic region 16 is relieved and the potential for injury is reduced.

Figure 4:
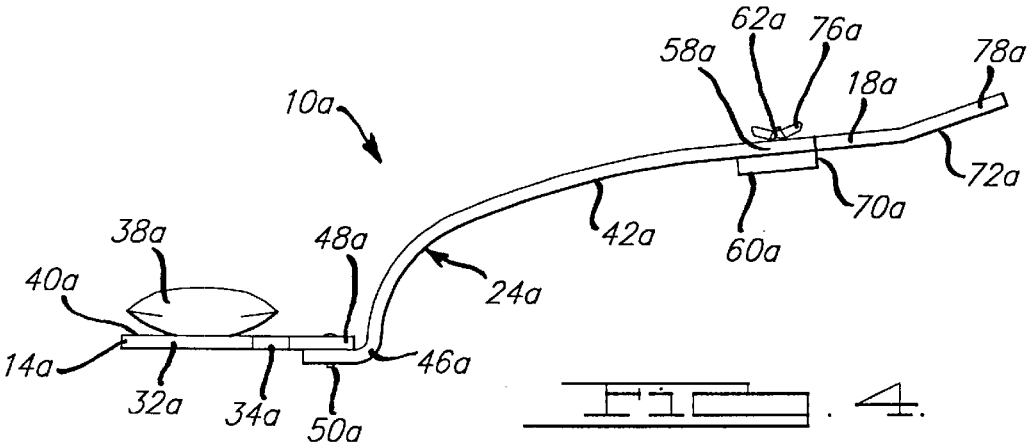
FIG. 4 is a side view of the exercise device of FIG. 3.
Figure 3:
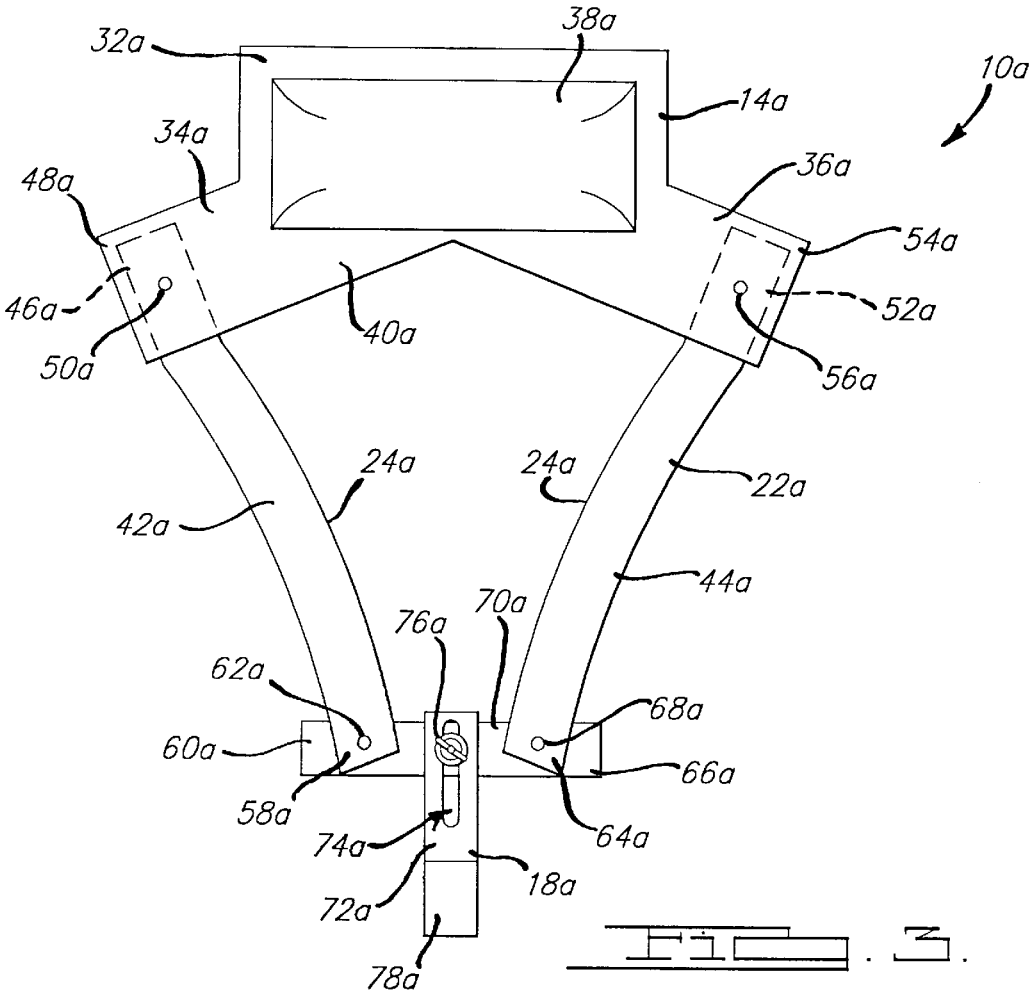
FIG. 3 is a top view of a first embodiment of the exercise device of the present invention.

Turning now to FIGS. 3 and 4, a first embodiment of the exercise device 10*a* is illustrated. The exercise device 10*a* includes a first or head, neck and thoracic supporting member 14*a* connected to a force receiving or hand grip member 18*a* by a connecting member 22*a*. More particularly, the first or head, neck and thoracic supporting member 14*a* includes a generally rectangular base 32*a* having a first flange 34*a* projecting at a given angle from a perimeter thereof. The base 32*a* also includes a second flange 36*a* projecting at a given angle from the perimeter of the base 32*a* opposite the first flange 34*a*. Preferably, the given angle between the first flange 34*a* and the base 32*a* and the given angle between the second flange 36*a* and the base 32*a* are approximately equal.

A generally rectangular crushable member or pad 38*a* is coupled to an upper surface 40*a* of the base 32*a* by adhesive, hook and loop fasteners, or other conventional means. Preferably, the pad 38*a* consists of a foam insert enclosed within a sweat-blocking vinyl-cloth enclosure although other crushable members may substitute therefor. Also, the base 32*a* preferably comprises machined aluminum sheet metal although other substantially rigid and light-weight materials such as molded plastic may substitute therefor.

The connecting member 22*a* includes a first connecting arm 42*a* and a second connecting arm 44*a*. The first connecting arm 42*a* is coupled at a first end 46*a* to an outboard end 48*a* of the head, neck and thoracic supporting member 14*a* by welding, adhesive, bolts, rivets, or other conventional fastening means 50*a*. Alternatively, the first connecting arm 42*a* may be made integral with the base 32*a* of the head, neck and thoracic supporting member 14*a*. Similarly, the second connecting arm 44*a* is connected at a first end 52*a* to a second outboard end 54*a* of the head, neck and thoracic supporting member 14*a* by conventional fastening means 56*a* or is formed integral therewith.

A second end 58*a* of the first connecting arm 42*a* is coupled to an outboard end 60*a* of the hand grip member 18*a* by conventional fastening means 62*a*. A second end 64*a* of the second connecting arm 44*a* is coupled to a second outboard end 66*a* of the hand grip member 18*a* by conventional fastening means 68*a*. The first and second connecting arms 42*a* and 44*a* include a pivot region 24*a* for cooperating with the chest of a user as illustrated in FIGS. 1 and 2.

Each of the connecting arms 42*a* and 44*a* are preferably arcuately shaped so as to extend between the head, neck and thoracic supporting member 14*a* and the hand grip member 18*a* so as to follow the shoulders of a user at a predetermined angle while maintaining clearance between the shoulders and connecting arms 42*a* and 44*a*. The predetermined angle is preferably selected so as to provide clearance with the shoulder and optimum leveraging of the head, neck and thoracic supporting member 14*a*. Also, the angle of curvature of the first and second connecting arms 42*a* and 44*a* is preferably selected to complement the angle of curvature of the shoulders of an average user of the exercise device 10*a*. As with the head, neck and thoracic supporting member 14*a*, the connecting member 22*a* may be formed of any substantially rigid and lightweight material such as tubular or sheet metal, or molded plastic among others.

The force receiving or hand grip member 18*a* is a generally T-shaped structure including a cross-bar 70*a* coupled to a grip bar 72*a* extending essentially orthogonal to the cross-bar 70*a*. The grip bar 72*a* includes an elongated slot 74*a* formed therein for adjustably cooperating with a post and fastener 76*a* interengaging the cross-bar 70*a* and the grip bar 72*a*. The fastener 76*a* preferably consists of a winged nut or star knob for facilitating easy adjustment of the length of the grip bar 72*a* although other conventional fasteners may substitute therefor. The grip bar 72*a* also includes an upwardly angled distal end 78*a* for providing a comfortable grip for the user.

Figure 5:
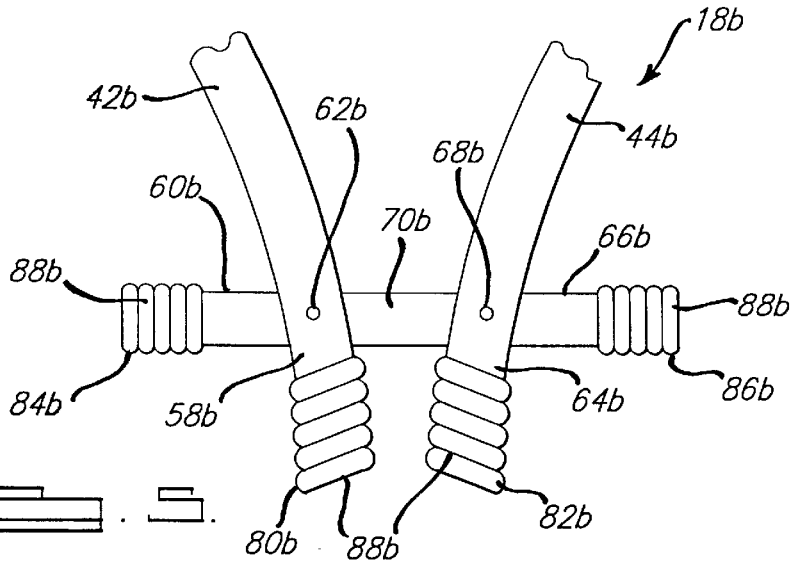
FIG. 5 is a top view of an alternate embodiment grip portion of the exercise device of FIG. 3.

Turning now to FIG. 5, an alternate embodiment force receiving or hand grip member 18*b* is illustrated. In this embodiment, the hand grip member 18*b* is a generally H-shaped structure. The second end 58*b* of the first connecting arm 42*b* and the second end 64*b* of the second connecting arm 42*b* extend beyond the cross-bar 70*b* to form first and second longitudinal grips 80*b* and 84*b*. Also, the outboard end 60*b* and second outboard end 66*b* of the cross-bar 70*b* extend beyond the first and second connecting arms 42*b* and 44*b* to form first and second horizontal grips 84*b* and 86*b*. Although the cross-bar 70*b* is illustrated as being coupled to the first and second connecting arms 42*b* and 44*b* with conventional fasteners 62*b* and 68*b*, it should be noted that an adjustable connection could be substituted therefor similar to the slot and post structure illustrated in FIG. 3. Each of the longitudinal grips 80*b* and 82*b* as well as the horizontal grips 84*b* and 86*b* are provided with a removable semi-crushable member or gripping surface 88*b*. Preferably, the gripping member 88*b* consists of a grip commonly known in the art as a bicycle handlebar grip.

Figure 6:
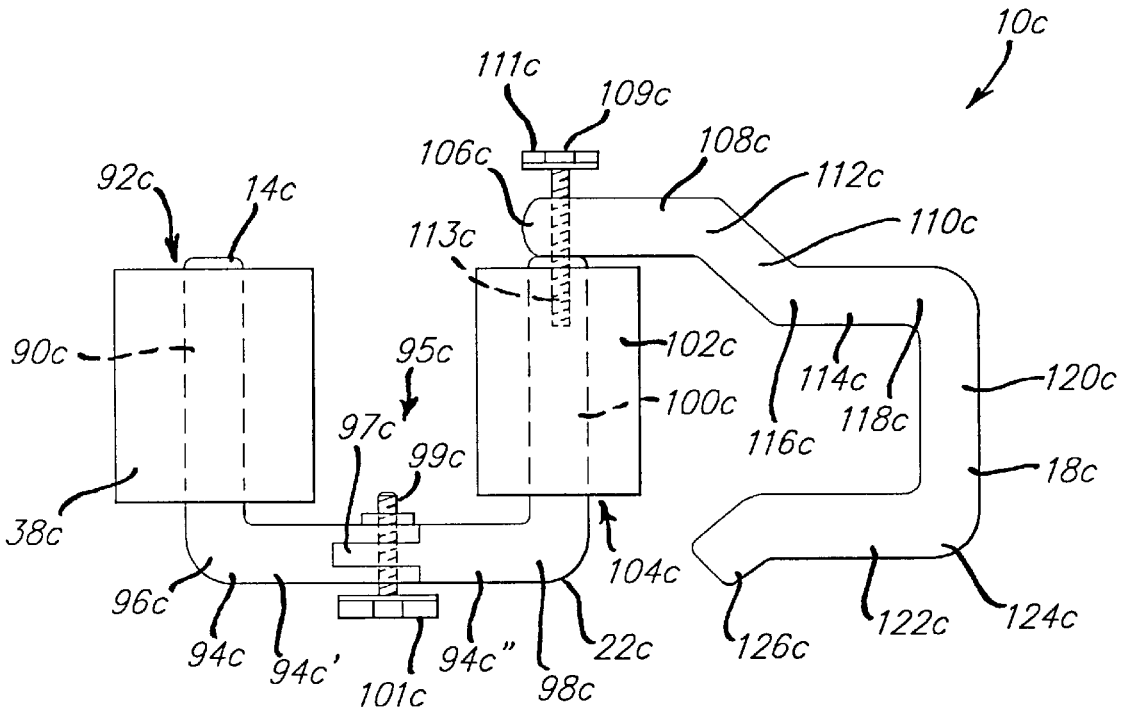
FIG. 6 is a top view of a second embodiment of the exercise device of the present invention.
Figure 7:
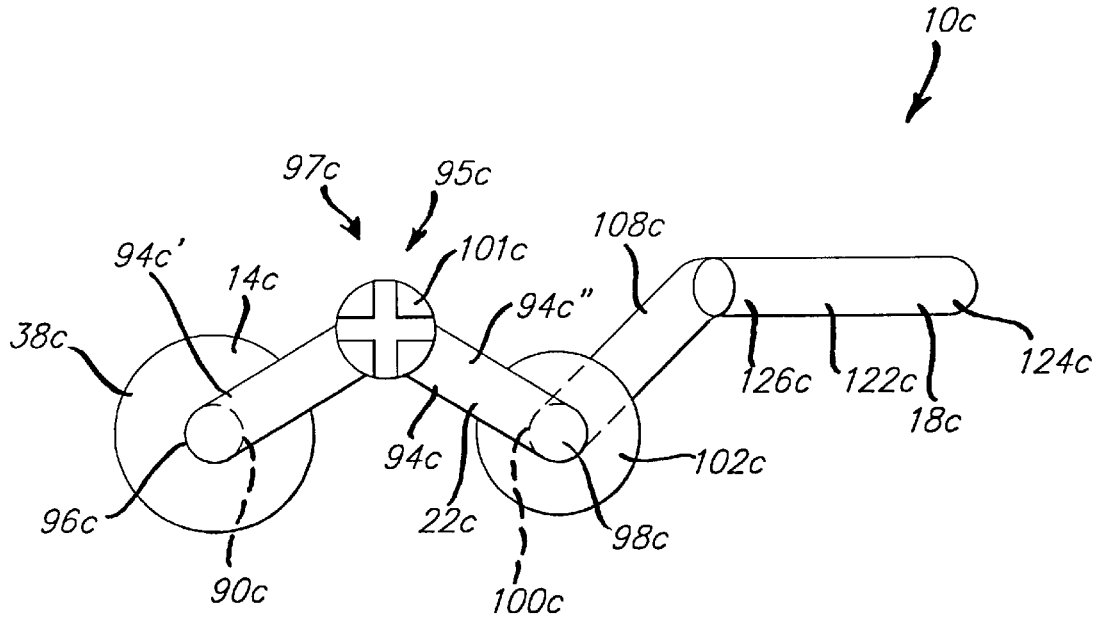
FIG. 7 is a side view of the exercise device illustrated in FIG. 6.

Turning now to FIGS. 6 and 7, another preferred embodiment of the exercise device 10*c* is illustrated. A first or head, neck and thoracic supporting member 14*c* is connected to a force receiving or hand gripping member 18*c* by a connecting member 22*c*. Preferably, the head, neck and thoracic supporting member 14*c*, connecting member 22*c*, and hand grip member 18*c* are formed from a continuous aluminum or rigid plastic tubular member which is bent or molded to its final desired shape. However, as an alternative, discrete component members may be removably secured together to provide a modular or foldable unit. Further, although a tubular exercise device 10*c* is illustrated, it should be appreciated that a rectangular, flat, or other configuration may substitute therefor so long as the connecting member 22*c* is sufficiently rigid to provide leveraging of the head, neck and thoracic supporting member 14*c* via the hand grip member 18*c*.

The first or head, neck and thoracic supporting member 14*c* includes a transverse neck bar 90*c* supporting an annular pad 38*c* thereabout. The annular pad 38*c* preferably includes a cylindrical foam member having an axial bore 92*c* formed therethrough for receiving the neck bar 90*c* and a vinyl covered cloth enclosure encasing the foam member having circular openings at either end for accommodating the neck bar 90*c*. The vinyl repels sweat from the foam insert. The connecting member 22*c* includes a first axially projecting bar 94*c* integrally formed with or coupled to the neck bar 90*c* at a first end 96*c*. Preferably, the neck bar 90*c* and first axial bar 94*c* are formed perpendicular to one another.

A second end 98*c* of the first axial bar 94*c* is integrally formed with or coupled to a second transverse or pivot bar 100*c*. The pivot bar 100*c* and first axial bar 94*c* are preferably formed perpendicularly to one another. Also, the pivot bar 100*c* preferably projects parallel to the first transverse bar 90*c*. The length of the first axial bar 94*c* is preferably selected such that the neck bar 90*c* and pivot bar 100*c* are axially spaced apart a sufficient distance for accommodating a typical user's neck and for placing the pivot bar 100*c* at an appropriate position along the user's chest.

Preferably, the first axial bar 94*c* includes two portions 94*c* ' and 94*c* " adjustably secured to one another at 95*c*. Although any number of adjustable connection means may be employed, a tongue and yoke mechanism 97*c* having a threaded member 99*c* with a star knob 101*c* secured thereto is presently preferred. By providing the adjustable connection 95*c*, the angle and clearance of the axial bar 94*c* relative to the shoulder of the user may be conveniently controlled.

A second annular pad 102*c* is disposed about the pivot bar 100*c* for cushioning the pivoting of the exercise device 10*c* along a user's chest. Preferably, the second annular pad 102*c* includes a cylindrical foam insert having an axial bore 104*c* formed therethrough for receiving the pivot bar 100*c*. The foam insert is preferably enclosed within a vinyl covered cloth (sweat proof) enclosure member having a circular opening at either end for accommodating the pivot bar 100*c*. The second annular pad 102*c* may also be provide with an enclosable slot or other elongated opening for facilitating direct installation and removal of the second annular pad 102*c* with respect to the pivot bar 100*c*. Although the diameter of the second annular pad 102*c* is illustrated as being different of the first annular pad 38*c*, it should be noted that the same diameter pads may also be utilized.

The pivot bar 100*c* is pivotably coupled to a first end 106*c* of a second axial bar 108*c*. The second axial bar 108*c* preferably projects parallel to the first axial bar 94*c*. The second axial bar 108*c* and pivot bar 100*c* preferably form a perpendicular angle with respect to one another. Additionally, the second axial bar 108*c* preferably projects at an angle to the plane defined by the neck bar 90*c* and pivot bar 100*c*. The angle of projection of the second axial bar 108*c* is selected to provide efficient leveraging of the head, neck and thoracic supporting member 14*c* by the user of the exercise device 10*c* when applying slight pressure to the hand grip member 18*c*. A second threaded member 109*c* having a star knob 111*c* engageable with a threaded bore 113*c* formed in the pivot bar 100*c* adjustably connects the pivot bar 100*c* to the second axial bar 108*c*. As such, the angle of the hand grip member 18*c* relative to the connecting member 22*c* may be tailored to the desires of the use. Also, the length of the second axial bar 108*c* is preferably selected so as to place the hand grip member 18*c* in an optimum rotation relative to the pivot bar 100*c* for providing leveraging of the head, neck and thoracic supporting member 14*c*.

The force receiving or hand grip member 18*c* is a generally U-shaped structure including a first angled bar 110*c* coupled to or formed integral with a second end 112*c* of the second axial bar 108*c*. A third axial bar 114*c* is integrally formed with or coupled to the first angled bar 110*c* at a first end 116*c*. The third axial bar 114*c* preferably projects parallel to the second axial bar 108*c*.

The third axial bar 114*c* is integrally formed or coupled at a second end 118*c* to a third transverse or grip bar 120*c*. The grip bar 120*c* and third axial bar 114*c* preferably form a perpendicular angle with respect to one another. Further, the grip bar 120*c* preferably projects parallel to the pivot bar 100*c*. A fourth axial bar 122*c* is integrally formed with or coupled to the grip bar 120*c* at a first end 124*c*. The fourth axial bar 122*c* preferably extends perpendicularly to the grip bar 120*c*. Also, the fourth axial bar 122*c* preferably projects parallel to the third axial bar 114*c*. The fourth axial bar 122*c* is integrally formed with or coupled to a second angle bar 126*c* at a second end 128*c*. The first angle bar 110*c*, third axial bar 114*c*, grip bar 120*c*, fourth axial bar 122*c* and second angle bar 126*c* preferably lie in a common plane which is parallel to but spaced apart from the plane defined by the neck bar 90*c* and pivot bar 100*c*.

The configuration of the exercise device 10*c* illustrated in FIGS. 6 and 7 enables a user to slide the device 10*c* into a neck region supporting position from the side rather than placing it over the head as is required with the embodiment illustrated in FIGS. 3 and 4. Furthermore, a padded and elongated pivot is provided for cooperating with a user's chest for facilitating leveraging of the head, neck and thoracic supporting member 14*c* via the hand grip member 18*c*. Further, the hand grip member 18*c* provides a variety of locations for placement of a user's hands.

Thus, the present invention provides an exercise device for supporting the head and cervical-thoracic region of a user during crunch-type exercises. The exercise device includes a head, neck and thoracic supporting member connected to a force receiving member by a connecting member including a pivot cooperating with a chest region of the user for providing leverage of the head, neck and thoracic supporting member via pressure on the force receiving member. As such, the correct posture of the head and cervical-thoracic region may be maintained while the abdominal muscles are being used to lift the torso during an ab crunch thereby minimizing stress to the cervical-thoracic region and reducing the potential for injury.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. An exercise device comprising:

a first supporting member to be located proximate a neck region of a user;

a force receiving member spaced apart from said first supporting member; and a connecting member extending between said first supporting member and said force receiving member, said connecting member defining a pivot point for said device, said pivot point between said first supporting member and said force receiving member, said pivot point of said connecting member for pivoting on the user wherein said pivot point assists in moving the first support member as force is applied on said force receiving member.

2. The exercise device of claim 1 wherein said connecting member includes an adjustment mechanism for changing a pre-selected angle.

3. The exercise device of claim 1 further comprising a pad coupled to said first supporting member.

4. The exercise device of claim 1 further comprising a pad coupled to said connecting member.

5. The exercise device of claim 1 wherein said connecting member further comprises a first connecting arm.

6. The exercise device of claim 5 wherein said connecting member further comprises a second connecting arm accommodating another shoulder of said user.

7. The exercise device of claim 6 wherein said first and second connecting arms are arcuately shaped to conform to said shoulders.

8. The exercise device of claim 1 wherein said force receiving member further comprises a generally T-shaped structure.

9. The exercise device of claim 1 wherein said force receiving member further comprises a generally U-shaped structure.

10. The exercise device of claim 1 wherein said force receiving member further comprises a generally H-shaped structure.

11. The exercise device of claim 1 wherein said force receiving member further comprises hand grips.

12. An exercise device comprising:

a first supporting member to be located proximate a neck region of a user;

a force receiving member spaced apart from said first supporting member; and a connecting member including a first section extending from said first supporting member and a second section extending at an angle between said first section and said force receiving member, said connecting member including a pivot point longitudinally disposed between said first supporting member and said force receiving member, said first supporting member being urged upward by a load being exerted downward on said force receiving member due to said device pivoting on said pivot point.

13. The exercise device of claim 12 wherein said connecting member includes an adjustment mechanism for changing said angle.

14. The exercise device of claim 12 wherein said connecting member further comprises a third section extending transversely between said first section and said second section for providing said at least one pivot along said portion of said user.

15. The exercise device of claim 12 further comprising an annular pad coupled to said first supporting member and an annular pad coupled to said connecting member.

16. An exercise device comprising:

a first supporting member adapted to support a head, neck or cervical thoracic region of a user;

a force receiving member spaced apart from said first supporting member;

a connecting member extending between said first supporting member and said force receiving member, said connecting member defining a pivot point for said device, said pivot point being located between said first supporting member and said force receiving member when said device is in an operational condition wherein said pivot point assists in moving the first support member as force is applied on said force receiving member.

* * * * *